US005924499A

United States Patent [19]

Birchak et al.

[11] Patent Number: 5,924,499

[45] Date of Patent: Jul. 20, 1999

[54] ACOUSTIC DATA LINK AND FORMATION PROPERTY SENSOR FOR DOWNHOLE MWD SYSTEM

[75] Inventors: James Robert Birchak, Spring; Clarence Gerald Gardner, Richmond; Kwang Yoo, Houston, all of Tex.

[73] Assignee: Halliburton Energy Services, Inc., Houston, Tex.

[21] Appl. No.: 08/837,582

[22] Filed: Apr. 21, 1997

[51] Int. Cl.[6] ..... E21B 47/00

[52] U.S. Cl. ..... 175/40; 175/50; 367/82; 367/83

[58] Field of Search ..... 175/40, 45, 50; 367/76, 81–83, 87, 95, 101

[56] References Cited

U.S. PATENT DOCUMENTS

| | | | |
|---|---|---|---|
| 4,283,780 | 8/1981 | Nardi | 367/82 |
| 4,293,936 | 10/1981 | Cox et al. | 367/82 |
| 4,293,937 | 10/1981 | Sharp et al. | 367/82 |
| 4,298,970 | 11/1981 | Shawhan et al. | 367/82 |
| 4,320,473 | 3/1982 | Smither et al. | 367/82 |
| 4,390,975 | 6/1983 | Shawhan | 367/82 |
| 4,511,843 | 4/1985 | Thoraval | 324/338 |
| 4,562,559 | 12/1985 | Sharp et al. | 175/40 |
| 4,715,022 | 12/1987 | Yeo | 367/83 |
| 4,785,247 | 11/1988 | Meador et al. | 324/338 |
| 4,805,156 | 2/1989 | Attali et al. | 367/35 |
| 4,964,085 | 10/1990 | Coope et al. | 367/35 |
| 5,248,857 | 9/1993 | Ollivier | 367/82 X |
| 5,375,098 | 12/1994 | Malone et al. | 175/40 X |
| 5,377,160 | 12/1994 | Tello et al. | 367/35 |
| 5,448,227 | 9/1995 | Orban et al. | 367/82 X |
| 5,467,832 | 11/1995 | Orban et al. | 175/45 |
| 5,517,464 | 5/1996 | Lerner et al. | 367/84 |

FOREIGN PATENT DOCUMENTS

| | | |
|---|---|---|
| 0552833 | 7/1993 | European Pat. Off. . |
| 0657622 | 6/1995 | European Pat. Off. . |
| 2247477 | 3/1992 | United Kingdom . |
| 2281424 | 3/1995 | United Kingdom . |

OTHER PUBLICATIONS

Schlumberger Limited; *Log Interpretation* vol. I—Principles; 1972 Edition; (pp.37–42) and (pp. 105–107).

Chapter 7; *Acoustic Logging*; Vogel and Summers and Broding; (pp. 95–102); undated.

EG&G Princeton Applied Research; *Take a Close Look at PARC's 5210 Two–Phase Lock–In For Performance and Value!*; (1 p.); undated.

*Primary Examiner*—Roger Schoeppel

*Attorney, Agent, or Firm*—Conley,Rose & Tayon, P.C.

[57] ABSTRACT

A system is disclosed for transmitting and receiving acoustic data signals in a well containing a drill string. The system includes devices for transmitting acoustic signals through the drill string, drilling mud, and formation, and further includes methods for transmitting and interpreting the acoustic signal so as to maximize accuracy of the transmission. The methods of the present invention include correlating signals transmitted along different paths or paths of different lengths, using frequency shift keying transmission, using shear waves to transmit signals through downhole equipment and using compression waves to transmit signals through the mud. The signals further give information about the frequency dependence of formation speed of sound and formation acoustic attenuation. The method also give information for imaging the locations of reflective boundaries in the material surrounding the borehole. The system offers the advantage to the driller of receiving essentially real time information about properties of the formation surrounding the bit.

35 Claims, 9 Drawing Sheets

ACOUSTIC DATA LINK AND FORMATION PROPERTY SENSOR FOR DOWNHOLE MWD SYSTEM

TECHNICAL FIELD OF THE INVENTION

The present invention relates generally to a downhole telemetry system for facilitating the measurement of formation, borehole and drilling data, storing the data in memory, and transmitting the data to the surface for inspection and analysis. More particularly, the invention relates to a measurement-while-drilling ("MWD") system that senses and transmits data measurements from the bottom of a downhole assembly a short distance around components in the drill string. Still more particularly, the present invention relates to an MWD system capable of measuring environmental conditions and operating parameters relating to the drill bit and/or motor and detecting formation bed boundaries and transmitting the data measurements in real-time around the downhole motor.

BACKGROUND OF THE INVENTION

The advantages of obtaining downhole data measurements from the motor and drill bit during drilling operations are readily apparent to one skilled in the art. The ability to obtain data measurements while drilling, particularly those relating to the operation of the drill bit and motor and the environmental conditions in the region of the drill bit, permit more economical and more efficient drilling. Some of the primary advantages are that the use of real time transmission of bit temperatures permits real time adjustments in drilling parameters for optimizing bit performance, as well as maximizing bit life. Similar measurements of drilling shock and vibration allow for adjusting or "tuning" parameters to drill along the most desirable path, or at the "sweet spot," thereby optimizing and extending the life of the drilling components. Measurement of the inclination angle in the vicinity of the drill bit enhances drilling control during directional drilling. Measuring the acoustic properties of the formation and locating bed boundaries near the bit enables the operator to steer the bit to the desired location in the formation.

According to conventional practice, the MWD tool is typically located in the drill string above the mud motor. This allows the electronic components of the MWD tool to be spaced apart from the high vibration and centrifugal forces acting on the bit. It has heretofore been difficult to successfully transmit detail MWD data around the mud motor. With the MWD tool positioned above the bit, however, a significant time lag is introduced between passage of the bit through a particular formation and transmission of data regarding the formation to the surface.

One advantage of positioning sensors closer to the bit is made clear in the following example, shown in FIG. 1. FIG. 1 depicts a downhole formation, with an oil-producing zone that has a depth of approximately twenty-five feet. A conventional steerable drilling assembly is shown in FIG. 1, which includes a drill bit, a motor, and a sensor sub located between 25–50 feet above the drill bit. As shown in FIG. 1, the drill bit and motor have passed through the oil-producing zone before the sensors are close enough to detect the zone. As a result, time is wasted in re-positioning and re-directing the downhole assembly. This is particularly costly in a situation where the intended well plan is to use the steerable system in FIG. 1 to drill horizontally into the zone.

If the sensors are located in, or closer to the bit, the sensors can detect the zone sooner, and the direction of the drilling assembly in FIG. 1 can be altered sooner in order to drill in a more horizontal direction and stay in the oil-producing zone. This, of course, is but one example of the advantages of placing the sensors in or very near to the bit. Other advantages of recovering data relating to the drill bit and motor will be apparent to those skilled in the art.

There are a number of systems in the prior art which seek to transmit information regarding parameters downhole up to the surface. Prior to the introduction of the assignee's electromagnetic short hop system, none of these prior art telemetry systems, sensed and transmitted data regarding operational, environmental, and directional parameters from below a motor to a position above the motor. These prior systems may be descriptively characterized as: (1) mud pressure pulse; (2) hard-wire connections; (3) electromagnetic waves; and (4) acoustic waves. A short hop system for transmitting a signal via electromagnetic waves is disclosed in U.S. Pat. No. 5,160,925 (the '925 patent), which is commonly assigned with the present application and hereby incorporated by reference in its entirety. The '925 patent discloses an electromagnetic short hop device that uses transformer coupling to transmit and receive a signal across a downhole motor. The present invention is directed to improvements in the area of acoustic transmissions.

The transmission of acoustic or seismic signals through a drill pipe or the earth (as opposed to through the drilling mud) offers another possibility for communication. In such a system, an acoustic or seismic generator is located downhole near or in the drill collar. However, a large amount of power is required downhole to generate a signal with sufficient intensity to be detected at the surface. The only way to provide sufficient power downhole (other than running a hard wire connection downhole) is to provide a large power supply downhole.

Space below the motor is extremely limited, so that there is not typically sufficient space for a power source to generate signals with the necessary intensity to reach the surface. This is especially true in a steerable system which has a bent housing, as shown in FIG. 2B. If the length of the assembly below the bent motor housing becomes too long, the side forces on the drill bit become excessive for the moment arm between the bent housing and the drill bit. Furthermore, when the motor is operating and the drill string is rotating, i.e., the system is drilling in a straight mode, the length between the drill bit and the bent housing becomes critical. The longer this length, the larger will be the diameter of the hole that will be drilled.

Thus, while it would be advantageous to obtain information regarding the operating parameters and environmental conditions of the drill bit and motor, to date no one has successfully developed an acoustic system capable of obtaining this near-bit data and transmitting it accurately back to the surface.

Several patents disclose various methods for using acoustic signals to transmit information through the drill string. U.S. Pat. No. 5,373,481 to Orban et al teaches operating the acoustic transmitter at the resonant frequency of the ceramic crystals in the transmitter, which is in the range of 20–40 kHz and more specifically about 25 kHz. Orban further teaches transmitting pulsed signals at one of two rates, either 6.25 msec between bursts, representing a logic bit "1", or 12.5 msec between bursts, representing a logic bit "0". According to Orban, the shift register looks for a pattern in 12.5 msec windows and makes an inquiry at 0, 5.25, 6.25 and 11.5 msec. This results in the signal 1010 being translated into a logic 1 and 1000 being translated into a logic 0. Further, according to Orban, all other patterns, e.g. 1111, 1011 and 1101, are considered generated by noise and are therefore ignored. When no recognizable pattern (i.e. either 1010 or 1000) is received, the logic value remains unchanged until a valid pattern is recognized. This approach has a high probability of missing data, as unrecognizable signals are ignored.

U.S. Pat. No. 4,390,975 to Shawhan, discloses a series of repeaters transmitting signals through a drill string at several different frequencies. The drill string according to Shawhan does not include a mud motor, and Shawhan relies on the transmission of a strong signal along the drill string path. According to Shawhan, a signal that consists of a sequence of DC pulses is divided into a number of time frames. Each time frame represents a bit of digital information. A "1" consists of a portion of a time frame in which a DC pulse is generated followed by a second portion in which a "0" signal is generated. A "0" is represented by a time frame in which there is an absence of a signal. Shawhan does not disclose a preferred frequency or time frame length.

British Patent 2,247,477A to Comeau teaches a method for transmitting information from a position near the bit to a receiver above the mud motor by means of an acoustic signal having a frequency in the range of 500 to 2,000 Hertz (0.5 to 2.0 kHz). It has been found that signals at this frequency are not easily transmitted through the downhole environment because the noise frequencies generated by downhole equipment are within approximately the same range. U.S. Pat. No. 5,124,953 to Grosso discloses using a frequency sweep device to determine an optimal transmission frequency from a transmitter located downhole to a receiver at the surface. Grosso teaches using frequencies ranging from 0.1 to 10 kHz. U.S. Pat. No. 5,128,901 to Drumheller discloses a method for transmitting an acoustic signal to the surface using frequencies less than 1.5 kHz.

None of the aforementioned references recognizes the problems inherent in the use of acoustical signals downhole. Specifically, none of the references discloses a method for transmitting an acoustic signal through the acoustically noisy environment adjacent the drill bit. The cutting action of the drill bit itself, the flow of drilling mud through the bit and the annulus, and operation of the mud motor all contribute significant acoustic noise. In addition to acoustical noise, the references fail to take into account changes in phase and amplitude caused by transmission of the acoustic signal through the complex downhole environment. Hence, it is desired to provide a device that can reliably transmit an acoustic signal from a transmitter located on or adjacent the drill bit to a receiver located several feet from the drill bit and preferably above the mud motor.

SUMMARY OF THE INVENTION

Accordingly, the present invention includes a data acquisition system for transmission of measured operating, environmental and directional parameters a short distance around a motor. Sensors are placed in a sensor module between the motor and the drill bit for monitoring environmental conditions in the vicinity of the drill bit. The sensors are capable of measuring the proximity and direction of bed boundaries in the vicinity of the bit. Sensors also may be positioned in the drill for monitoring the operation and direction of the motor and bit and are electrically connected to circuitry in the sensor module. The sensor module includes transducers for transmitting acoustic signals indicative of the measured data recovered from the various sensors. The sensor module may also include a processor for conditioning the data and for storing the data values in memory for subsequent recovery. In addition, the sensor module includes receivers for receiving acoustic signals from a control module uphole. The control module is positioned a relatively short distance away in a control transceiver sub, either above or below the mud pulser collar. The control module includes transmitters and receivers for transmitting command signals and for receiving signals indicative of sensed parameters to and from the sensor module. The control receivers receive the acoustic signals from the sensor transmitters and relay the data signals to processing circuitry in the control module, which formats and/or stores the data. The control module transmits electrical signals to a host module, which connects to all measurement-while drilling ("MWD") components downhole to control the operation of all the downhole sensors.

The host module includes a battery to power all of the sensor microprocessors and related circuitry. Thus, the host module also powers the control module circuitry. The host module connects to a mud pulser, which, in turn, transmits mud pulses, reflecting some or all of the sensed data, to a receiver on the surface.

Both the sensor module and the control module include transducer arrangements through which the acoustic signals are sent and received. The transducers are comprised of multiple stacks of piezoelectric crystals or other magnetostrictive or electrostrictive devices. The sensor or downhole transducers are strategically mounted on the exterior of a sub or extended driveshaft, and the control or uphole transducers are mounted on the exterior of the control sub.

The present invention may be used with a wide variety of motors, including mud motors, with or without a bent housing, mud turbines and other downhole devices that have motion at one end relative to the other. The present invention may also be used in circumstances where no motor is used, to convey data from the drill bit a short distance in a downhole assembly, such as, for example, around a mud pulser. The system can also use telemetry systems other than a mud pulser to relay measured data to the surface. Because the acoustic signal need only travel a relatively short distance according to the present invention, a relatively small power supply can be used, such as a battery. The battery, located downhole near the sensor module, provides power to the transducers, the sensors and the processor. Like the sensor module, the battery can be located either in the driveshaft of the motor or in a separate, removable sub (as described in the preferred embodiment).

Because the acoustic properties of the downhole environment may vary greatly, the present invention is capable of operating over a wide range of frequencies. The system operates by determining the frequency that functions best for a given formation and transmitting at that frequency to maximize the signal-to-noise ratio. The signal can be transmitted through multiple acoustic paths, including the drill string, the mud, the formation, and combinations of these, and can be transmitted even when a mud motor is present in the string. The present invention provides means for optimally sending a signal over one or more of these paths.

The present invention also includes techniques for eliminating noise from a received signal, which is particularly useful when the signal has been transmitted from one side of a mud motor to the other. One technique for reducing noise is to correlate the received signal with one or more generated reference signals and search for a maximum product of the two signals.

These and various other characteristics and advantages of the present invention will become readily apparent to those skilled in the art upon reading the following detailed description.

BRIEF DESCRIPTION OF THE DRAWINGS

For a detailed description of the preferred embodiment of the invention, reference will be made now to the accompanying drawings, wherein.

During the course of the following description, the terms "uphole," "upper," "above" and the like are used synonymously to reflect position in a well path, where the surface of the well is the upper or topmost point. Similarly, the terms "downhole," "lower," "below" and the like are also used to refer to position in a well path where the bottom of the well is the furthest point drilled along the well path from the surface. As one skilled in the art will realize, a well may vary significantly from the vertical, and, in fact, may at times be horizontal. Thus, the foregoing terms should not be regarded as relating to depth or verticality, but instead should be construed as relating to the position in the path of the well between the surface and the bottom of the well.

DETAILED DESCRIPTION OF THE PREFERRED EMBODIMENT

I. DOWNHOLE DRILLING SYSTEM

Figure 1:
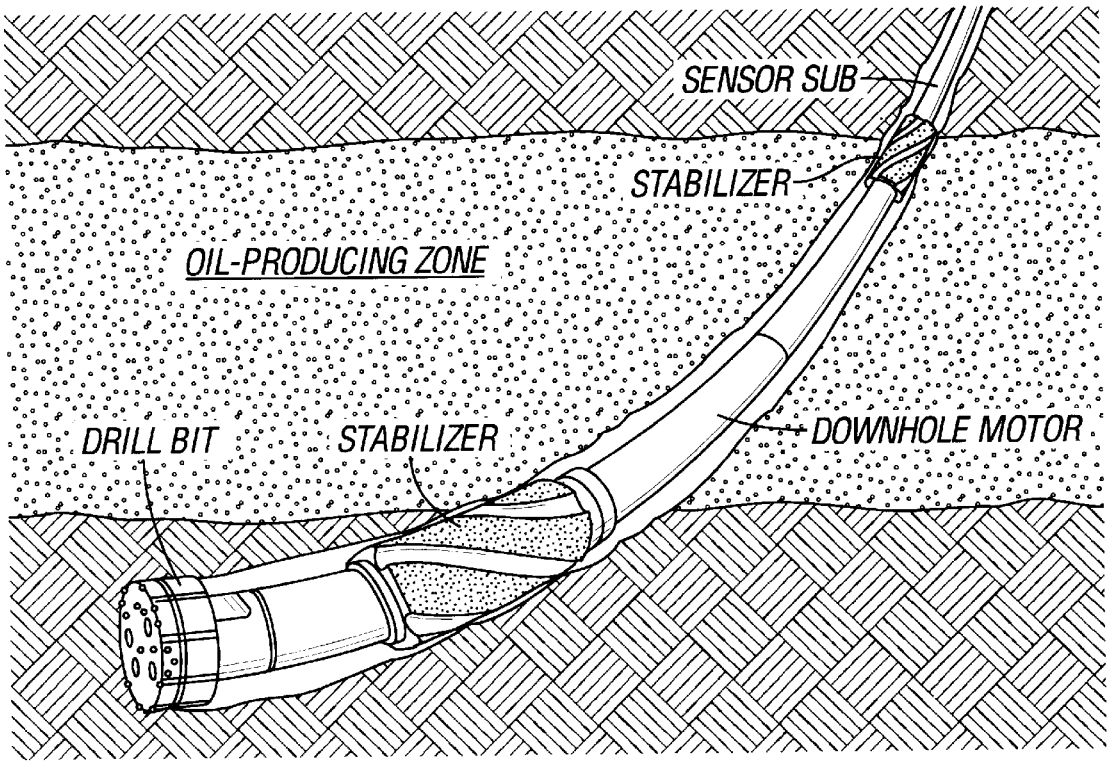
FIG. 1 (Prior Art)
FIG. 1 is a perspective view of a prior art directional drilling assembly drilling through an earth formation.
Figure 2A:
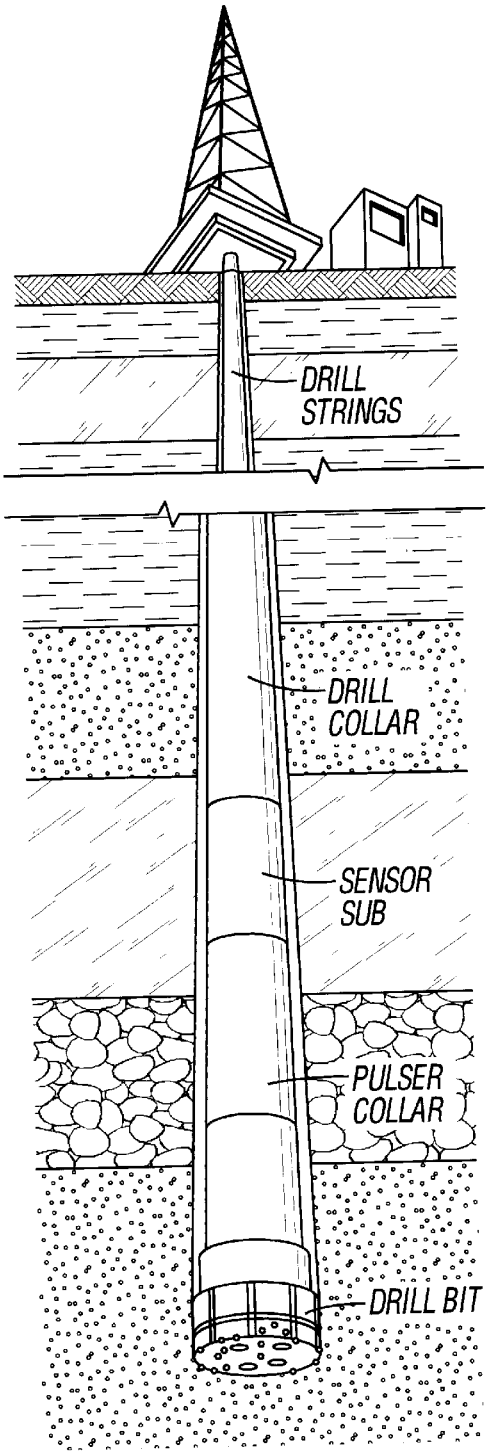
FIG. 2A (Prior Art)
FIG. 2A is a perspective view of a prior art rotary drilling system.
Figure 2B:
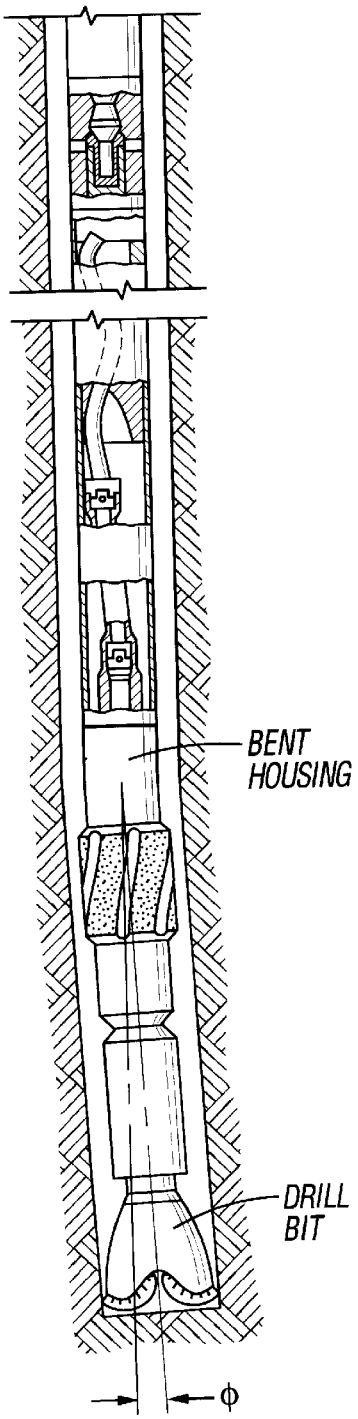
FIG. 2B (Prior Art)
FIG. 2B is a partially sectional front elevation of a prior art steerable drilling system.

Two prior art drilling systems are shown in FIGS. 2A and 2B. FIG. 2A illustrates a prior art drilling system that operates solely in a rotary mode, while FIG. 2B depicts a prior art steerable system that permits both straight and directional drilling. The rotary drilling system shown in FIG. 2A includes a drill bit with a pulser collar for relaying data to the surface via mud pulses. Above the pulser collar is a sensor sub which includes a variety of sensors for measuring parameters in the vicinity of the drill collar, such as resistivity, gamma, weight-on-bit, and torque-on-bit. The sensors transmit data to the pulser, which in turn, transmits a mud pressure pulse to the surface. An example of a mud pulse telemetry system may be found in U.S. Pat. No. Nos. 4,401,134 and 4,515,225, the teachings of which are incorporated by reference as if fully set forth herein. A non-magnetic drill collar typically is located above the sensor modules. Typically, the drill collar includes a directional sensor probe. The drill collar connects to the drill string, which extends to the surface. Drilling occurs in a rotary mode by rotation of the drill string at the surface, causing the bit to rotate downhole. Drilling mud is forced through the interior of the drill string to lubricate the bit and to remove cuttings at the bottom of the well. The drilling mud then circulates back to the surface by flowing on the outside of the drill string. The mud pulser receives data indicative of conditions near, but not at, the bottom of the well, and modulates the pressure of the drilling mud either inside or outside the drill string. The fluctuations in the mud pressure are detected at the surface by a receiver.

The prior art steerable system shown in FIG. 2B has the added ability to drill in either a straight mode or in a directional or "sliding" mode. See U.S. Pat. No. 4,667,751, the teachings of which are incorporated by reference as if fully set forth herein. The steerable system includes a motor which functions to operate the bit. In a prior art motor, such as that disclosed in U.S. Pat. No. 4,667,751, the motor includes a motor housing, a bent housing, and a bearing housing. The motor housing preferably includes a stator constructed of an elastomer bonded to the interior surface of the housing and a rotor mating with the stator. The stator has a plurality of spiral Ad cavities, n, defining a plurality of spiral grooves throughout the length of the motor housing. The rotor has a helical configuration, with n-1 spirals helically wound about its axis. See U.S. Pat. Nos. 1,892,217, 3,982,858, and 4,051,910.

During drilling operations, drilling fluid is forced through the motor housing into the stator. As the fluid passes through the stator, the rotor is forced to rotate and to move from side to side within the stator, thus creating an eccentric rotation at the lower end of the rotor.

The bent housing includes an output shaft or connecting rod, which connects to the rotor by a universal joint or knuckle joint. According to conventional techniques, the bent housing facilitates directional drilling. See U.S. Pat. No. Nos. 4,299,296 and 4,667,751. To operate in a directional mode, the bit is positioned to point in a specific direction by orienting the bend in the bent housing in a specific direction. The motor then is activated by forcing drilling mud therethrough, causing operation of the drill bit. As long as the drill string remains stationary (it does not rotate), the drill bit will drill in the desired direction according to the arc of curvature established by the degree of bend in the bent housing, the orientation of the bend and other factors such as weight-on-bit. In some instances, the degree of bend in the motor housing may be adjustable to permit varying degrees of curvature. See U.S. Pat. No. Nos. 4,067,404 and 4,077,657. Typically, a concentric stabilizer also is provided to aid in guiding the drill bit. See U.S. Pat. No. 4,667,751.

To operate in a straight mode, the drill string is rotated at the same time the motor is activated, thereby causing a wellbore to be drilled with an enlarged diameter. See U.S. Pat. No. 4,667,751. The diameter of the wellbore is directly dependent on the degree of bend in the bent housing and the location of the bend. The smaller the degree of bend and the closer the placement of the bend is to the drill bit, the smaller will be the diameter of the drilled wellbore.

The bearing housing contains the driveshaft, which connects to the output shaft by a second universal or knuckle joint. The eccentric rotation of the rotor is translated to the driveshaft by the universal joints and the output shaft, causing the driveshaft to rotate. Because of the tremendous amount of force placed on the motor downhole, radial and thrust bearings are provided in the bearing housing. One of the functions of the bearings is to maintain the driveshaft concentrically within the bearing housing. Representative examples of radial and thrust bearings may be found in U.S. Pat. Nos. 3,982,797, 4,029,368, 4,098,561, 4,198,104, 4,199,201, 4,220,380, 4,240,683, 4,260,202, 4,329,127, 4,511,193, and 4,560,014. The necessity of having bearings in the driveshaft housing contributes greatly to the difficulty in developing a signaling system that transmits data through or around a motor.

II. SHORT HOP DATA ACQUISITION SYSTEM

Figure 3:
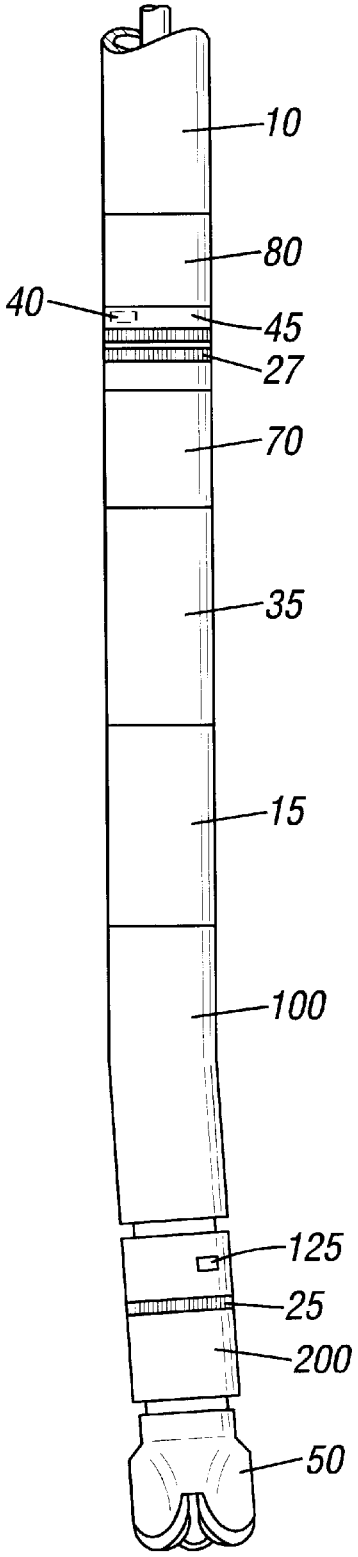
FIG. 3 is a schematic diagram of the preferred embodiment of the short hop data telemetry system, which utilizes an extended sub between the motor and drill bit.
Figure 4:
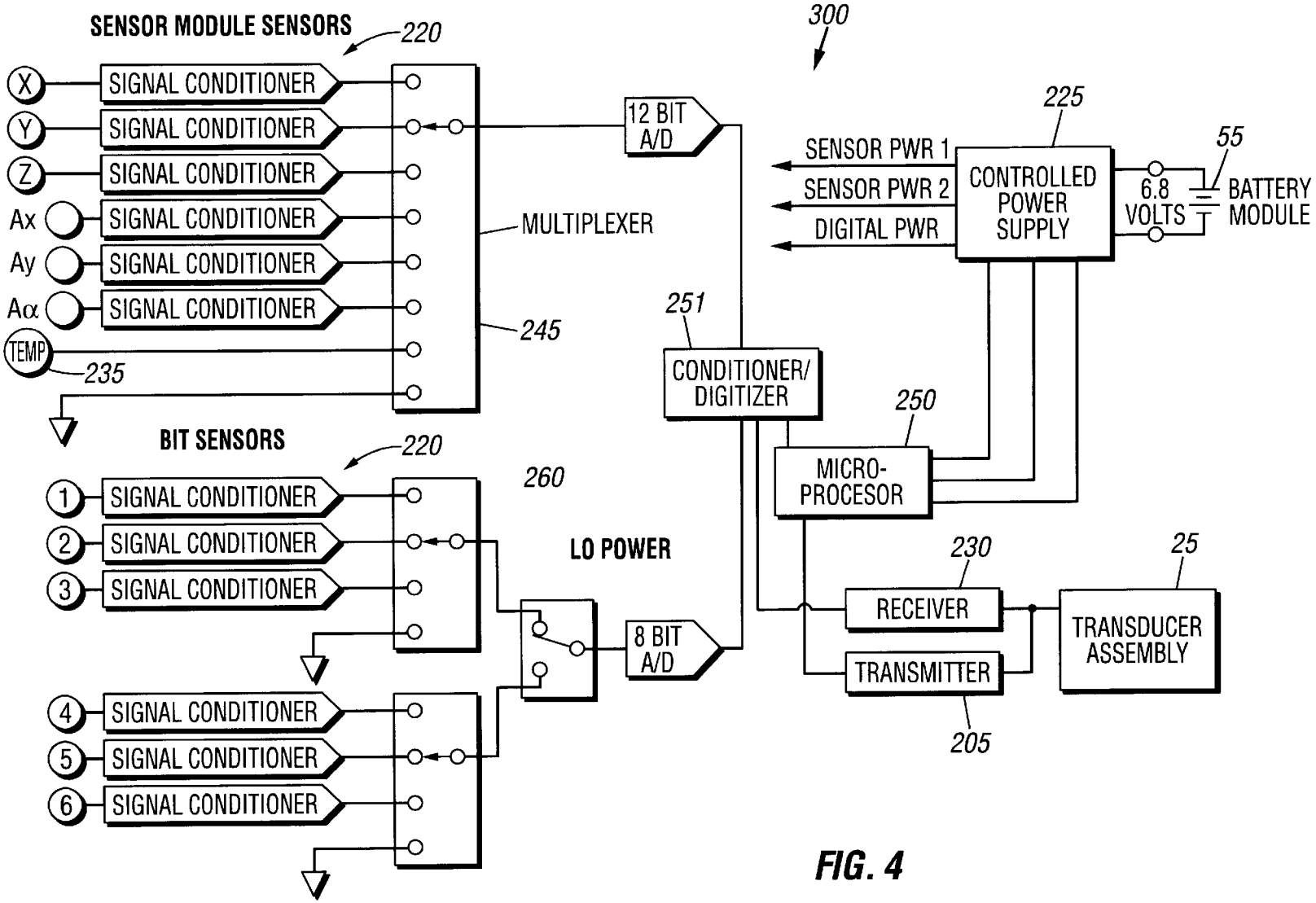
FIG. 4 is a schematic illustration of the sensor module circuitry.
Figure 5:
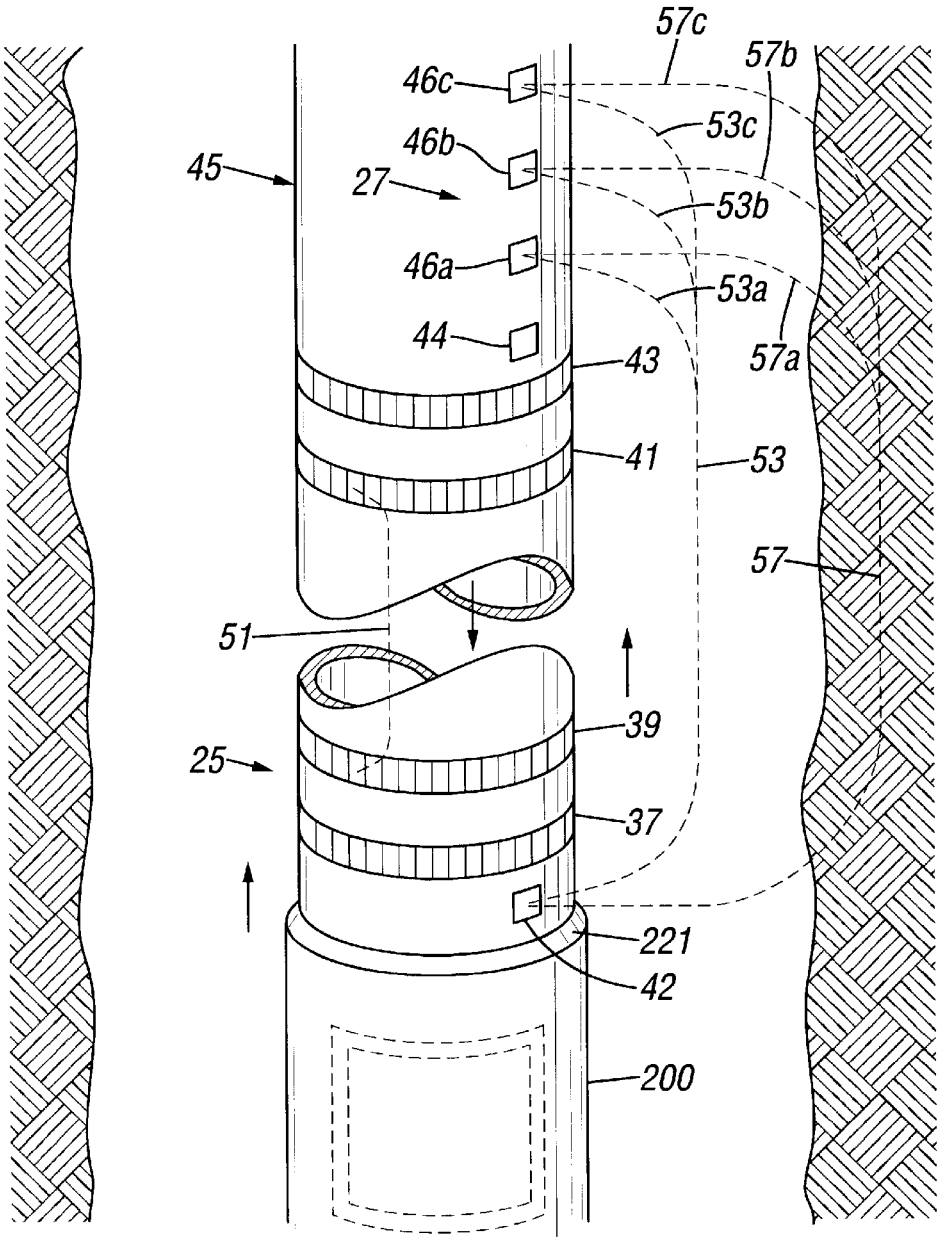
FIG. 5 is a partly schematic, partly isometric fragmentary view of the short hop system shown in FIG. 3.

Referring now to FIG. 3, the short hop data acquisition system configured in accordance with the preferred embodiment comprises a drill bit 50, a motor 100 with an extended sub 200 connected to the drill bit 50, a sensor transducer assembly 25 located on the exterior of the sub 200, a sensor module 125 positioned inside the extended sub 200, a pulser collar 35 positioned uphole from the motor 100, a control module 40 located in a control sub 45 near pulser collar 35, a host module 10, a control transducer assembly 27 mounted on the exterior of control sub 45, and a guard sub 70. A drill collar (not shown) and drill string (not shown) connect the downhole assembly to the drilling rig (not shown), according to conventional techniques. Other subs 15 and/or sensor subs 80 may be included as required in the downhole system. Likewise, alternative embodiments of the system are shown in FIG. 4 and 5 of the '952 patent (incorporated above) and discussed in the related portions of the '952 patent.

A. Motor and Extended Sub

Referring again to FIG. 3, the motor 100 preferably comprises a Dyna-Drill positive displacement motor with a bent housing, made by Smith International, Inc., as described, supra, in Section I Downhole Drilling System and as shown in U.S. Pat. No. 4,667,751. Other motors, including mud turbines, mud motors, Moineau motors, creepy crawlers and other devices that generate motion at one end relative to the other, may be used without departing from the principles of the present invention.

In accordance with the preferred embodiment, motor 100 connects to extended sub 200 which houses sensor module 125 and its associated transducer assembly 25. One particular advantage of this embodiment is that extended sub 200 may be removed and used interchangeably in a variety of downhole assemblies. The exterior of extended sub 200 preferably comprises a generally cylindrical configuration and supports sensor transducer assembly 25 as described in detail below.

Housed within sub 200 is a battery pack (not shown) for supplying power to the sensor circuitry. The battery pack preferably comprises a "stack" of two "double D" (DD) size lithium battery cells, encased in a fiberglass tube 131 with epoxy potting, having power and power-return lines terminating at a single connector on the lower or downhole end of the battery pack. In the preferred embodiment, the connector comprises an MDM connector. The battery pack preferably includes conventional integral short circuit protection (not shown), as well as a single integral series diode (not shown) for protection against unintentional charging, and shunt diodes across each cell (not shown) for protection against reverse charging, as is well known in the art. The top end of the sensor module 125 preferably is configured such that the battery pack can be connected and disconnected, both mechanically and electrically, at a field site, for the primary purposes of turning battery power on and off and replacing consumed battery packs.

The sensors and various supporting electrical components housed within the sensor module 125 preferably include environmental acceleration sensors, an inclinometer and a temperature sensor. The environmental acceleration sensors, according to techniques which are well known in the art, preferably measure shock and vibration levels in the lateral, axial, and rotational directions. The inclinometer, also well known in the art, preferably comprises a three axis system of inertial grade servo-accelerometers, which measures the inclination angle of the sub axis, below the motor 100 and very close to the bottom of the well. The accelerometers are mounted rigidly and orthogonally so that one axis (z) is aligned parallel with the sub axis, and the other two (x and y) are oriented radially with respect to the sub. The inclinometer preferably has the capability to measure inclination angles between zero and 180 degrees.

B. Connector Assembly

The electrical connection between drill bit 50 and acoustic sensor module 125 is preferably made as described in U.S. Pat. No. 5,160,925. The connector assembly is preferably constructed to permit connection or disconnection of bit sensors in a field environment, as required to interchange drill bits, acoustic sensor modules, and/or battery packs. The connector assembly is preferably maintained in a dry environment, protected from operating environmental pressures. In addition, the connector assembly connects electrically to the acoustic sensor module 125 assembly and is preferably spring loaded to preserve the integrity of the connection with the drill bit. The connector wiring and conductor configuration permits mating and disconnection of the connector while the module is powered up, without causing any damage to acoustic module 125.

C. MWD Host Module

Figure 8:
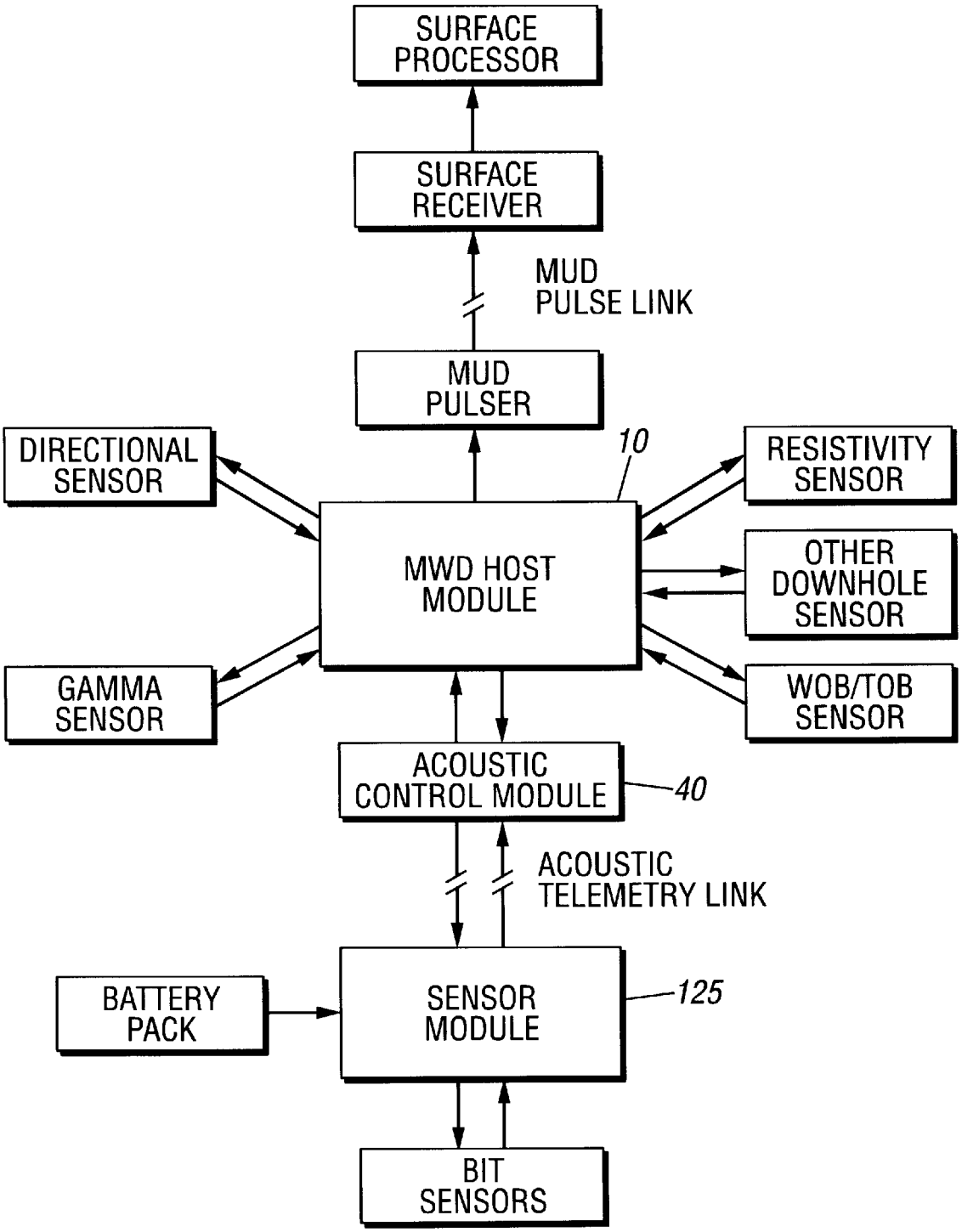
FIG. 8 is a block diagram depicting the electronic and telemetry components of the short hop data telemetry system of FIG. 3.

Referring briefly to FIG. 8, the MWD host module 10 preferably comprises a microprocessor based controller for monitoring and controlling all of the MWD components downhole. As shown in the preferred embodiment of FIG. 8, the host module receives data signals from the acoustic control module, a gamma sensor, a resistivity sensor, a weight-on-bit/torque-on-bit ("WOB/TOB") sensor, and other MWD sensors used downhole, each of which includes its own microprocessor. A bus (not shown) is preferably provided to connect the MWD host module to the acoustic control module and the other MWD sensors. In addition, the host module preferably includes a battery to power the host module, and the MWD sensors through the bus line.

The host module preferably transmits command signals to the sensors, such as the acoustic control module, prompting the sensors to obtain and/or send data signals. The host module receives the data signals and provides any additional formatting and encoding to the data signals which may be necessary. In the preferred embodiment, the host module preferably includes additional memory for storing the data signals for retrieval later. The host module preferably connects to a mud pulser and transmits encoded data signals to the mud pulser, which are relayed via the mud pulser to the surface.

D. Sensor Circuitry

Referring again to FIG. 4, the acoustic sensor module circuitry 300 preferably includes a microprocessor 250, a conditioner/digitizer 251, a transmitter 205 and receiver 230, both of which connect electrically to the sensor transducer assembly 25, signal conditioning circuitry 220, a controlled power supply 225 connected to the battery pack 55 and various sensors for measuring environmental acceleration, inclination and temperature.

The acoustic sensor module circuitry 300 preferably includes the following sensors within the acoustic sensor module 125 (FIG. 3): (1) three inclinometer sensors, shown as X, Y, Z in FIG. 4; (2) three environmental acceleration sensors, shown as $A_x$, $A_y$, $A_z$; and (3) a temperature sensor 235. In addition, the sensor circuitry 300 may receive up to six input signals from sensors positioned in the bit. In the preferred embodiment, the bit sensors measure temperature and wear on the bit.

Referring still to FIG. 4, the output signals from the inclinometer sensors and environmental acceleration sensors are fed to conventional signal conditioning circuitry 220 to amplify the signals and reduce noise. The signals, together with the output signal from the temperature sensor 235, are input to a multiplexer 245. In the preferred embodiment, the multiplexer 245 comprises an 8:1 multiplexer. Similarly, the output signals from the bit sensors are supplied as input signals to the signal conditioning circuitry 220, and then relayed to a multiplexer 260.

The signals from the acoustic module sensors and bit sensors are digitized in conditioner/digitizer 251 and processed by microprocessor 250 and the processed signals then are stored in memory until needed. The processing preferably includes formatting and coding the signals to minimize the bit size of the signal. Additional memory may be included in sensor circuitry 300 to store all of the sensed signals for retrieval when sensor module 125 is retrieved from downhole.

Power for acoustic sensor circuitry 300 is obtained from controlled power supply 225. Power supply 225 connects to the battery pack and receives dc power from it. Power supply 225 converts the battery power to an acceptable level for use by the digital circuits. In the preferred embodiment, the battery pack supplies power at 6.8 volts DC.

Once it is determined that the processed sensor signals are to be transmitted uphole, which preferably is upon command from control module 40, microprocessor 250 retrieves some or all of the processed signals, performs any additional formatting or encoding which may be necessary, and outputs the desired signal to transmitter 205. Transmitter 205 connects electrically to transducer assembly 25 and provides a signal to transducer assembly 25, at a frequency determined by the acoustic sensor microprocessor, which in turn causes the transmission of an acoustic signal that is received at control transducer assembly 27 (FIG. 3).

E. Acoustic Path

Referring now to FIG. 5, it has been found that the acoustic signal can be effectively transmitted from a sensor transceiver assembly to the control transceiver assembly, or vice versa, through one or more paths that include a path 51 through the drill string (i.e. through the bottom hole assembly), a path 53 through the mud in the annulus, a path 57 through the formation, and/or combinations thereof. A key aspect of the present invention lies in providing means for optimizing the transmission along one or more of these paths.

1. Drill String Path

For example, transmission of the acoustic signal through the bottom hole assembly is preferably carried out using shear or flexural waves rather than compression waves. Use of shear or flexural waves, in which the vibration is perpendicular to the direction of wave propagation, allows a signal to be propagate axially through the mud motor, even though the configuration of the motor effectively damps any compressional waves passing axially therethrough.

Figure 6:
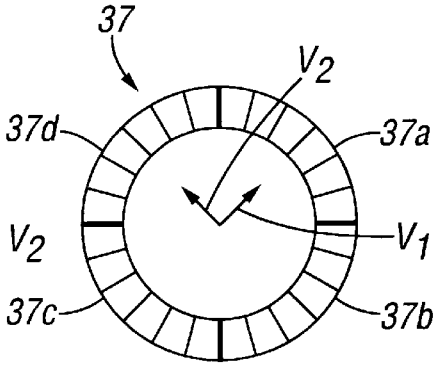
FIG. 6 is a schematic plan of a transducer ring.

Referring again to FIG. 5, when it is desired to transmit an acoustic signal through the bottom hole assembly using shear or flexural waves, transducer assemblies 25, 27 each preferably include at least one transducer ring 37, 41, respectively, mounted such that the majority, if not all, of its vibrational energy is transmitted to the bottom hole assembly. To this end, transducer rings 37, 41 are preferably in good contact with the bottom hole assembly, while being isolated from the surrounding mud to the extent possible. Each transducer ring comprises a plurality of piezoelectric crystals mounted circumferentially around the sub or drill pipe as shown in FIG. 6. According to a preferred embodiment, there are 3 to 30 crystals in each ring. These crystals are pulsed to obtain selected orientations of vibrational motion.

If the number of crystals is divisible by four, as shown in FIG. 6, each ring of crystals 37 can be divided into quadrants 37*a*, 37*b*, 37*c* and 37*d*. The crystals in one opposed pair of quadrants 37*a*, 37*c* can be actuated in a single direction, resulting in a force represented by vector $V_1$ applied to the drill pipe. This is followed one-half cycle later by the actuation of the same crystals to obtain a force in the opposite direction. A similar actuation is applied to the other opposed pair of quadrants 37*b*, 37*d*, also in a single azimuth, resulting in a force represented by vector $V_2$ applied to the pipe. The resulting orthogonal forces illustrated by the vectors $V_1$, $V_2$ acting on the pipe create two independent shear waves having a propagation direction traveling axially up (and down) the pipe. Analogously, a trio of crystal elements can be used to create shear waves that are not orthogonal but can be differentiated from one another.

In order to receive the signals embodied in these shear waves, transducer assemblies 25, 27 each include a receiver ring 39, 43, respectively, that operates conversely to the operation of transducer rings 37, 41. That is, receiver rings 39, 43 convert lateral forces acting on them by the pipe into changes in an output voltage signal. This allows the shear waves to be received, as well as information about their azimuthal orientation.

Furthermore, it is possible to simultaneously transmit more than two signals through the bottom hole assembly by utilizing multiple flexural waves having differing azimuthal orientations. If a second transducer ring of crystals is provided, it can be divided into quadrants actuated in a manner that produces similar shear waves having azimuthal orientations that are different from those of the first transducer ring. Because rings of transducers/receivers can be set according to these principles so as to preferentially receive shear waves having a particular azimuthal orientation, multiple signals comprising simultaneously transmitted shear waves having different orientations can be received and translated, so long as sufficient receiver crystals are provided to interpret the different orientations.

2. Mud Path

Referring again to FIG. 5, when it is desired to transmit an acoustic signal along paths 53 through the mud in the annulus instead of through the bottom hole assembly, transducer assemblies 25, 27 each further include at least one isolated transducer 42, 44, respectively, acoustically isolated from its housing and mounted such that its vibrational energy is transmitted to the mud. Transducers 42, 44 are preferably mounted by attaching the nonvibrating neutral point to the tool. This neutral point is on the plane through the center of mass of the transducer. The construction can include a piezoelectric cylinder backed by an impedance matched damping material, such as tungsten rubber. It is preferred to use compressional waves for transmission through mud, as shear waves are not effectively transmitted through liquids. It has been found that the transmission of compressional waves through the mud is enhanced by the guiding effect of the annulus, which tends to contain the compressional waves, allowing them to travel farther with less spreading of the radiation pattern.

Furthermore, as shown in FIG. 5, it is preferred to provide a plurality of isolated receivers such as 46*a*, 46*b* and 46*c* to receive the signal from transducer 42 so as to allow more accurate recognition of the transmitted signals. Receivers 46*a*, 46*b* and 46*c* are axially spaced from each other as shown and, like transmitters, 42, 44, are acoustically isolated from the drill string and sensitive to vibrations in the mud. Because path 53*a* from transmitter 42 to receiver 46*a* is shorter than path 53*c* from transmitter 42 to receiver 46*c*, a signal from downhole will arrive at receiver 46*c* later than it arrives at receiver 46*a*. Since the velocity of sound through the mud can be independently determined by conventional methods, and the axial distance between receivers in a module is known, the expected time interval between arrivals can be calculated. Using this information, signals received at different receiver distances can be correlated, so as to reinforce recognition of a transmitted signal. Use of correlation techniques in this manner allows the system to reject both waves moving in the wrong direction and those moving at the wrong speed.

It will be understood that a plurality of transmitters and receivers on the sensor module (not shown) can be configured in the same manner as shown for the control module, with the same associated advantages. Similarly, these correlation techniques can be used to enhance recognition of signals transmitted along various other paths.

3. Formation Path

Compressional and flexural waves can also be used to transmit a signal through the formation, but this path is the least preferred, as it involves the greatest attenuation, scattering and spreading of the signal and results in a more complex signal being received at the receiver. If it is desired to use the formation path, transmitters and receivers isolated from the drill string, such as those described above with respect to the mud path are used. This path has the advantage of traveling faster than the mud signal and therefore avoiding interferences from mud modes. For a highly attenuating mud motor, this path may be preferred. It has the further advantage of providing formation speed of sound at the bit.

F. Control Sub

Figure 7:
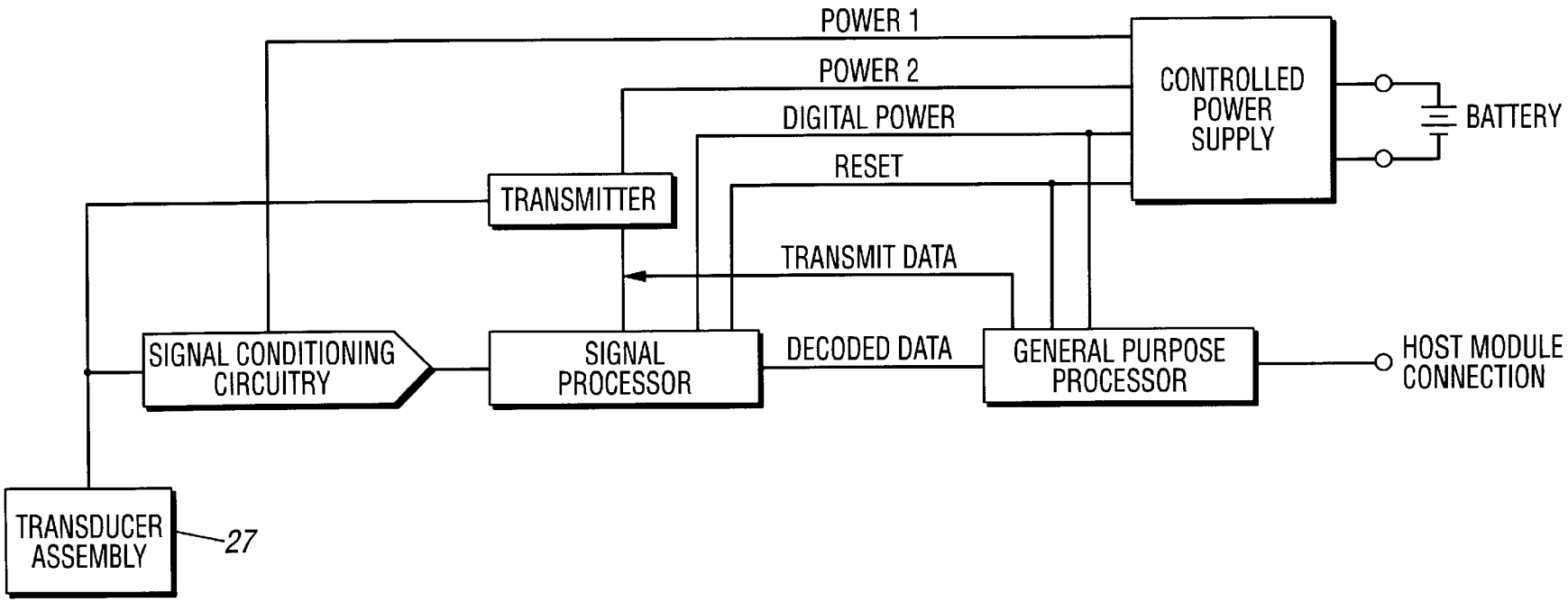
FIG. 7 is a schematic illustration of the control module circuitry.

Referring briefly to FIG. 3, the acoustic control sub 45 constructed in accordance with the preferred embodiment comprises control transducer assembly 27 mounted thereon, and a acoustic control module 40 housed therein. Control module 40 preferably connects to the host module by a single conductor wireline cable. Referring now to FIG. 7, the control module 40 includes signal conditioning circuitry for conditioning the acoustic data signals received from the sensor module via transducer assembly 27. The conditioned signals are fed to a signal processor which deciphers the encoded signals from the sensor module. The decoded signals then are sent to the general system processor, which relays the data signals to the host module. Power for the control module circuitry is supplied by a battery module and a controlled power supply.

As shown in FIG. 8, the acoustic control module 40 preferably includes a hard wired connection to the host MWD module common bus, which also connects to all other MWD sensors that are above the bit telemetry link. Electrical power for the acoustic control module is supplied by the bus.

In operation, control module 40 transmits command signals, via the acoustic telemetry link, to sensor module 125, ordering sensor module 125 to acquire data from some or all of the sensors located in sensor module 125 or bit 200, and transmit back (via the same acoustic link) that data. This data is preferably averaged, stored, and/or formatted for presentation to control module 40, which in turn, reformats the data for incorporation into a mud pulse transmission mode format and data stream. Higher frequency data, which must be stored in the control module downhole, may be copied and/or played back at the surface after the module is pulled out of the hole.

Communication is established with the acoustic sensor module one or more acoustic paths as described supra, in Section E.

G. Signal Interpretation

Regardless of the acoustic path or paths selected for a given transmission, the signal received at the other end of the path will differ greatly from what was originally transmitted. First, the received signal will be delayed in real time by an amount equal to the path distance between the transducers divided by the velocity of sound along that path. Second, the phase and amplitude of the received signal will be altered, as portions of the signal travel along different paths and interfere with each other at the receiver. Third, the duration of any portion of the signal will be greater than the duration of that portion originally transmitted, as the variation in path lengths and path velocities will result in signals being received over a range of times. Lastly, reverberation of the tool itself can increase the duration of the received signal.

The present invention utilizes a variety of techniques to enable the receivers to extract a readable signal from the receiver input. First, it is preferred that the sensor and control modules use synchronized clocks. The clocks are synchronized prior to installation in the hole and resynchronized downhole. By using synchronized clocks, the real-time transmission modulation timings can be calculated at the receiver and more accurate collection of signal data is possible by generating a correlation reference signal at the receiver. If signals are transmitted along multiple paths independently, the known or calibrated difference in delay between the multiple media can be used to confirm the arrival of the first path mode. Second, arrays of receiving transducers can be used in conjunction with signal correlation techniques as described above to extract a signal at a known frequency from input containing substantial noise. Such arrays can be used at both the sensor and control modules.

Figure 9A:
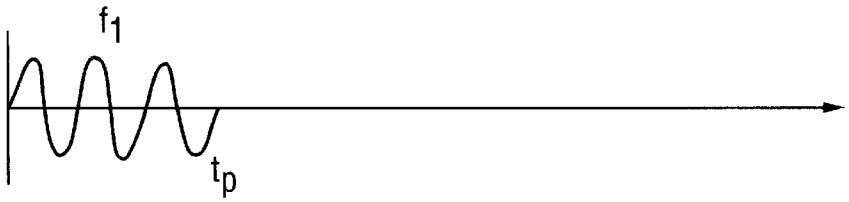
FIGS. 9A–F show various transmitted, received and processed signals.
Figure 9B:
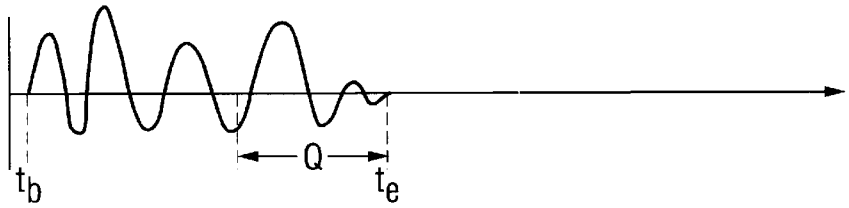

Referring now to FIGS. 9A and 9B, it can be seen that passage through the downhole environment affects both the amplitude and phase of a transmitted signal. Specifically, in FIG. 9A, a single signal pulse at frequency $f_1$ is transmitted for a time $t_p$, after which there is no transmitted signal. In FIG. 9B, receipt of the same signal pulse at a receiver some distance away begins at time $t_b$ and can be detected until some final time $t_e$. The initial transmission delay $t_o$ depends on path length and will be ignored in the following discussion. As shown in the Figure, the duration of the received pulse, defined by the interval between $t_b$ and $t_e$, is greater than the initial duration of the pulse, $t_p$.

At 8 kHz in a downhole environment, the difference in length between the received pulse and the transmitted pulse can be as long as 36 ms (300 cycles). This interval is hereinafter referred to as the ring-down time, Q. During downhole calibration, Q can be determined on the basis of quantitative measurements for that well, or can be determined on the basis of previously gathered experimental data.

According to the present invention, the transmitted signal can be modulated in phase, amplitude, or frequency at a rate that allows all transients to decay before the next modulation period. The modulation period is selected to exceed the maximum predicted or measured ring-down time Q for a given well. That is, the transmitting and receiving devices are programmed to transmit information at one bit per modulation period $T_s$. After modulation transients decay, the carrier signal for a particular path will consist essentially of a single frequency with constant amplitude and phase. The unknown amplitude and phase of the received signal depend on the superposition of carrier signal arrivals from all paths, which are assumed to have constant relative carrier phases during one modulation period. In this manner, it is ensured that all residual signal reverberation resulting from a given modulation period will be fully exhausted before commencement of the following modulation period. This method for transmitting information results in a significantly slower baud rate. Nevertheless, as the overall data transmission rate of the system is still limited by the 1–10 baud rate of the typical mud pulsing device, a reduction in the baud rate of the acoustic telemetry system is of little consequence.

Figure 9C:
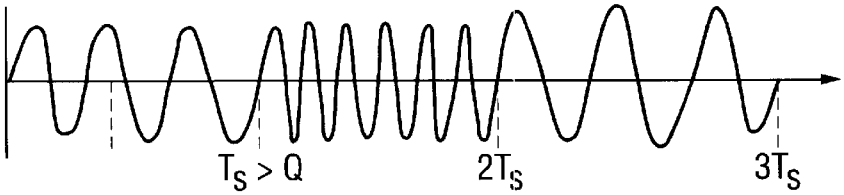
Figure 9D:
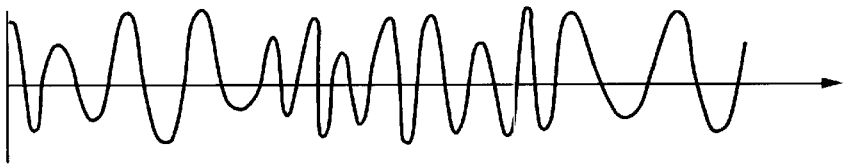
Figure 9E:
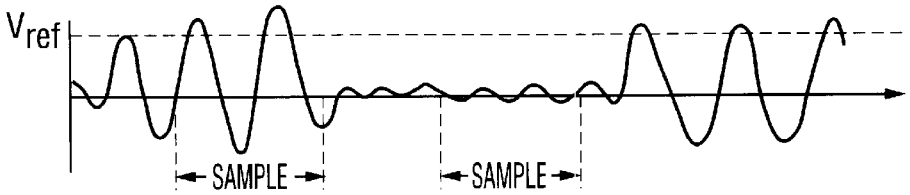
Figure 9F:
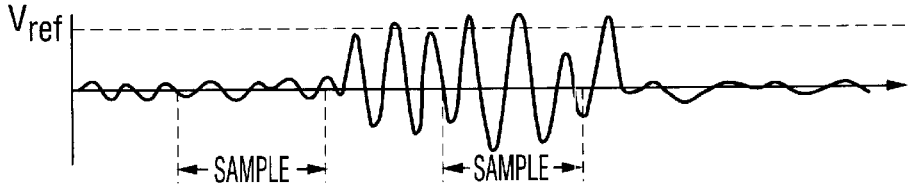
Figure 10:
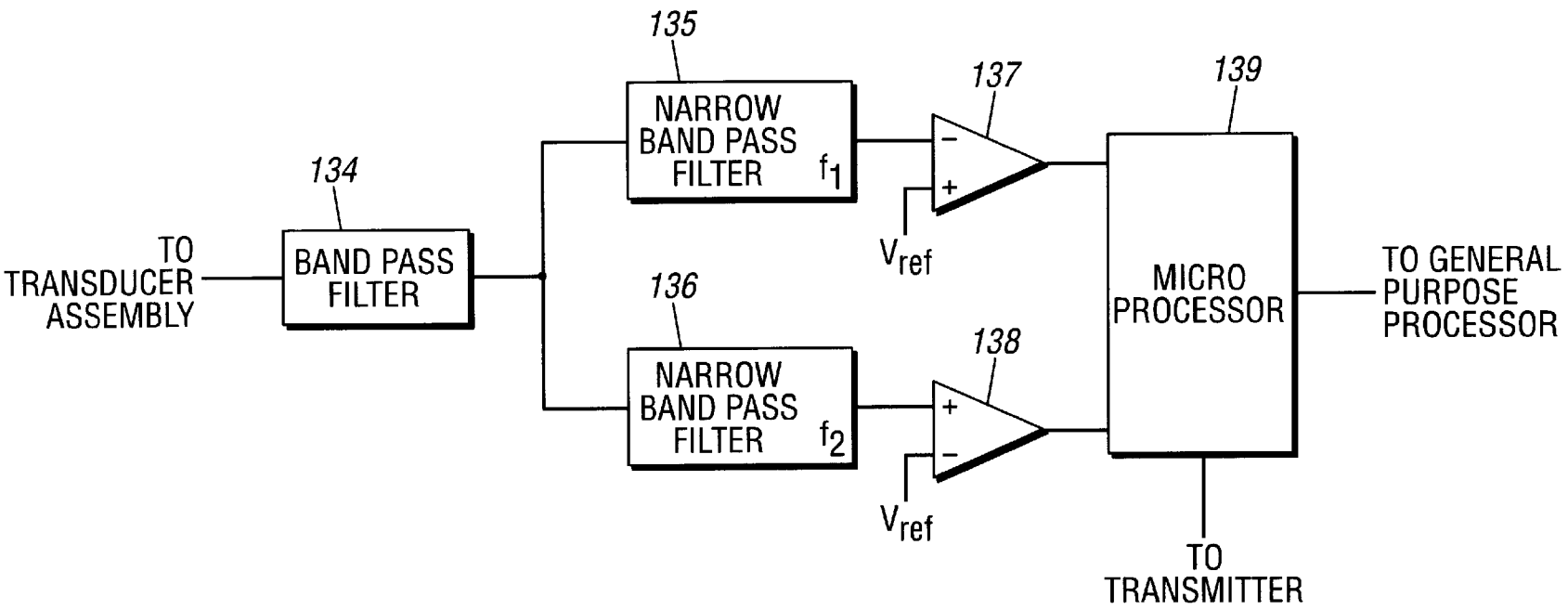
FIG. 10 is a schematic diagram of the signal processing circuitry of FIG. 8.

Another technique for ensuring accurate signal translation entails the use of frequency shift keying. This technique is illustrated in FIGS. 9C–F and the signal processor of FIG. 7 is represented schematically in FIG. 10. FIG. 9C shows a signal modulated between $f_1$ and $f_2$ on intervals equal to $T_8$. FIG. 9D shows the same signal as it is received after passage along one or more of the various signal paths. As described above, the received signal no longer matches the transmitted signal in either phase or amplitude. As shown in FIG. 10, the signal conditioning circuitry includes a band pass filter 134, which includes $f_1$ and $f_2$ in the pass band but rejects higher and lower frequencies. The pass band signal in turn feeds two additional narrow band-pass filters 135, 136, each of which recognizes only signals having a predetermined range of frequencies. Alternatively, one high-pass and one low-pass filter can be used, as will be understood by those skilled in the art. The receiver filter outputs are interrogated after all modulation transients have decayed. In response to the received input signal, filters 135, 136 (FIG. 10) will output signals corresponding to the sample periods shown in FIGS. 9E and 9F. The output of each filter 135, 136 is passed through a comparator 137, 138. Comparators 137, 138 help to eliminate noise by detecting only those signal inputs having at least a predetermined minimum amplitude value $V_{ref}$. The outputs of comparators 137, 138 are fed to a microprocessor 139, which yields a digitized signal corresponding to the frequency information originally transmitted. In the microprocessor, a comparison of the filter outputs is made, and, if the output for frequency $f_1$ is stronger than that for frequency $f_2$, a binary "1" is recorded, otherwise a binary "0" is recorded. The transmitted carrier frequency switches to reflect the desired binary signal. Using binary frequency shift keying in this manner, both "1's" and "0's" are assigned distinct frequencies and only receipt of a positive signal at one of the two frequencies is treated as data, in contrast to amplitude shift keying, which uses a single frequency and translates the absence of a signal as a "0". The use of frequency shift keying greatly increases the noise rejection for transmissions in the presence of broad band noise. Broadband impulse noise typically produces equal responses in adjacent narrow band filters. By rejecting equal amplitude signals at $f_1$ and $f_2$, mistransmissions can be identified and corrected. For example, if, during transmission, a time interval passes in which both frequencies have equal strengths, the receiving module can be programmed to query the transmitting unit regarding the missing bit following completion of the transmission.

This embodiment requires synchronization of the transmitter modulation and receiver interrogation time. The sampling detector is synchronized coherently with the transmitter modulation time by using crystal controlled clocks. This method ensures interrogation during the sampling period in the time interval between Q and $T_s$, when only one carrier frequency exists. The existing frequency will be detected by one of the two band pass filters. This procedure represents synchronization at the modulation frequency, not at the carrier frequency.

Another technique that is used according to the present invention entails use of different azimuthal planes of vibration to produce binary information. More specifically, a single transducer that is small in size compared to the wavelength of the signal transmitted will create shear, flexural and compressional modes. The compressional mode becomes essentially a uniform front after it has traveled axially a distance equal to approximately 7 to 10 times the diameter of the cylinder. As a uniform front, it loses information about the azimuthal position of the transducer. In contrast, the shear and flexural modes are polarized along one azimuth. Essentially no flexural energy propagates with an orthogonal polarization. Thus, the shear and flexural modes contain information about the azimuth of the transducer even when they have traveled a significant axial distance.

Applying a second relatively small transducer located some, preferably 90, degrees from the first transducer in the azimuthal plane and operating it at a different frequency from the first transducer gives two independent shear polarizations or flexural polarizations as well as the compressional mode. The compressional mode received at some axial distance from the transducers comprises the superposition of the individual compressional signals and has amplitude beating at the difference frequency, regardless of the azimuthal position of the transducers. In contrast, the resulting shear and flexural signals are polarized and the azimuthal plane of polarization rotates around a longitudinal axis at the difference frequency.

Although rotation of the near bit sub causes rotation of the near bit transducers, which is superimposed on the apparent rotation of the shear and flexural waves, this mechanical rotation is relatively slow and can be rejected from the processed signal using electronic filtering. Specifically, rotation of the near bit sub will cause the received signal to appear unmodulated when the transmitters are aligned with the receivers and the sum of the received signals to appear unmodulated when the transmitters have rotated 45 degrees from the receivers. On the other hand, received signal is modulated when the transmitters have rotated 45 degrees from the receivers and the sum of the received signals is modulated when the transmitters are aligned with the receivers. Thus, by monitoring both the received signals and the sum of the received signals, it is possible to always detect a modulated signal. The relative strengths and phases of the two monitored channels can be used to determine the angular orientation of the rotating bit relative to the static drill string. Since the rotation of the plane of the shear or flexural mode is rapid, compared to the rate of rotation of the drill bit, the bit orientation will be relatively constant during few cycles of demodulated difference frequency that it takes to identify the relative amplitudes and phases of the demodulated difference frequency for each receiver signal and the sum of the receiver signals.

In this manner, the binary signal described above is obtained by observing the rotation of the polarization vector at the average carrier frequency. If the carrier vector's positive peak progresses from $VR_1$ to $(VR_1+VR_2)$ to $VR_2$ to $(VR_1-VR_2)$ to $VR_1$, the rotation can be designated as a binary "1", while the reverse rotation from $VR_1$ to $(VR_1-VR_2)$ to $VR_2$ to $(VR_1+VR_2)$ to $VR_1$ can be designated as a binary "0".

Alternatively, if the carrier frequency polarization rotation is difficult to detect because of a large noise factor, the demodulated signals can be assigned "1" and "0" characteristics themselves. For example, one transmitter can be at a fixed frequency and the other transmitter assigned two frequencies. This approach gives two different rotation frequencies, one of which is assigned a "1" and the other of which is assigned a "0". This approach allows phase sensitive detection of the demodulated frequencies relative to synchronized clocks at the bit and uphole subs.

In the foregoing, the synchronized clocks are used to interpret the demodulated signals. In addition to the foregoing, the present invention includes a technique for extracting useable information by special processing to extract the carrier signals from an otherwise noisy transmission. Specifically, the present technique entails creating a windowed sinusoidal reference signal at the carrier frequency and correlating the received signal against it. The modulated envelope produced by the carrier correlation is in turn correlated against a second windowed sinusoidal reference signal with frequency equal to the modulation frequency. In this way, for w carrier frequencies and y modulation frequencies, a word of length w·y bits can be transmitted and received in each valid time window after ringdown. Thus, the use of two carrier frequencies and two demodulation frequencies allows the transmission of four bits of information per valid time window.

According to the preferred technique, the transmitted signal is sampled at a sampling period $\Delta t$ that is preferably less than one-fourth the carrier period and more preferably equal to one-tenth the carrier period. This generates a stream of sample points A. Assuming that m=number of modulation cycles in the valid time window, n=number of carrier cycles per modulation cycle, and p=number of sample points per carrier cycle, then q=(m)(n)(p)=number of sample points per valid time window.

The sample points A of the carrier are correlated with a carrier reference signal B having the same frequency as the transmitted acoustic carrier waveform. Preferably, the window for signal B has an integer number of cycles and an even number of sample points to minimize problems with dc offsets. The carrier correlation is performed over a small number s of carrier cycles.

Assuming that:

s=number of carrier cycles in the reference signal window and v=(p)(s)=number of sample points per carrier cycle, when processing starts, the points of A are correlated with B to form a set of points D forming an envelope of the carrier. To obtain an envelope of the carrier, an orthogonal set of reference function is used similar to those of discrete Fourier transforms. For sinusoidal references, the orthodonal functions for frequency $f_j$ are $\sin(2\pi f_j t_i)$ and $\cos(2\pi f_j t_i)$ Data point $D_{v/2}$ is obtained by correlating sample points from $A_l$ to $A_v$ and is associated with sample time $t_{v/2}$. $D_{q-v/2}$ is associated with time $t_{q-v/2}$. The set of possible D's has v fewer entries than the set of A's. If $D_u$ is one of these q-v data points, it is described by the equation:

$$D_u = \left[\left(\sum_{i=-v/2}^{v/2} [A_{u+i} \cdot \sin(2\pi f_j t_{u+i})]\right)^2 + \left(\sum_{i=-v/2}^{v/2} [A_{u+i} \cdot \cos(2\pi f_j t_{u+i})]\right)^2\right]^{1/2} \quad (1)$$

Usually, only a small fraction of the possible D's need to be calculated. If $f_z$ is the modulation frequency with period $t_z$, $D_u$'s must be calculated for time intervals of no more than $t_z/4$ and preferably no more than $t_z/10$. If the envelope has noise spikes, all $D_u$'s can be calculated and smoothed by averaging and decimating to obtain the desired $t_z/10$ samples per modulation cycle.

The series of computations described above can be performed for different carrier frequencies by calculating a set of D's for each frequency. For a data system having two carrier frequencies, $f_{c1}$ and $f_{c2}$ the ratio $$R_c = D_u(f_{c1})/D_u(f_{c2}) \quad (2)$$

is large when $f_{c1}$ is received and small when $f_{c2}$ is received. Noise is likely to give $R_c=1$. For data transmission purposes, a threshold $R_{cT}$ is selected to identify valid data. $R_T>R_{cT}$ is treated as a "1" and $R_T<1/R_{cT}$ is treated as a "0." $R_c$ between $1/R_{cT}$ and $R_{cT}$ is treated as noise. $R_{cT}$ is determind during calibration and adjusted to optimize data rate for the noise conditions in the well.

In addition to encoding information by changing carrier frequencies, a given carrier frequency can be modulated at different modulation frequencies. If the carrier is modulated, the $D_u$ data will have amplitude modulations at the modulation frequencies. Assuming that the described as $D_0'$ to $D_r'$. A second reference signal E is created, having the same period, sample rate and repetitive waveform as the modulation. Cross correlation can then be calculated for each sample point in the valid time interval. For sinusoidal modulation frequency $f_z$, the D's are correlated to form a set of points G that identify the modulation frequency according to the following equation (Equation 3):

$$G_k = \left[\left(\sum_{l=-r/2}^{+r/2} [D'_{(k+l)} \cdot \sin(2\pi f_z t_{k+l})]\right)^2 + \left(\sum_{l=-r/2}^{+r/2} [D'_{(k+l)} \cdot \cos(2\pi f_z t_{k+l})]\right)^2\right]^{1/2}$$

This $G_k$ corresponds to sample time $t_k$. The ratio $$R_m = G_k(f_{z1})/G_k(f_{z2}) \quad (4)$$

is treated as a "1" for $R_m>R_{mT}$ and as a "0" for $R_m<1/R_{mT}$ $R_m$ between $1/R_{mT}$ and $R_{mT}$ is treated as noise. $R_m$ is a threshold selected to optimize the data rate.

The four-bit word for the carrier consists of the "1" or "0" from the carrier and the "1" or "0" from the modulation. This technique effectively eliminates significant amounts of noise and enables the receipt of legible signals even in the noisy environment associated with the down-hole motor. It will be understood that the data processing technique described above can be used with any of several different reference signal modulations, or "words," each of which can be independently recognized, thereby allowing the amount of data transmitted to be greatly increased.

H. System Operation

Communication between the sensor module 125 and control module 40 is effected by acoustic propagation along multiple acoustic paths. Each module contains both transmitting and receiving circuitry, permitting two-way communication. In operation, the desired transducer is actuated to generate a modulated acoustic signal, preferably in the frequency range of 5 kHz to 40 kHz and more preferably at about 8 to 20 kHz. As described above, this signal is created by applying rapid pulses of an appropriate voltage across one or more piezoelectric crystals, causing them to vibrate at a rate corresponding to the frequency of the desired acoustic signal. The balance of the following discussing will address techniques for optimizing successful transmission of a desired signal between a single transmitter/receiver pair located in the drill string. It will be understood that many of the same principles apply and could be used simultaneously to transmit signals between other transmitter/receiver pairs in the same hole. For example, signals can be sent simultaneously via the mud path using compressional waves and via the drill string path using shear waves.

The acoustic wave excited by the transducer propagates through the drill string and surrounding earth. As the acoustic wave propagates, it is attenuated by spreading, frictional losses and dissipation according to generally understood principles. Because dissipation increases as frequency increases, the desired transmission distance will effectively set a maximum operable frequency.

It has been found that the metal components that make up the lower end of a drill string, including the bit, collars, various subs, and the mud motor, have a resonant frequency at approximately 8 kHz. According to the present invention, it is preferred to operate at this resonant frequency, as it allows a maximum signal amplitude for a given power input and therefore allows the transmitted signal to travel further through the downhole environment. The 8 kHz frequency is well above the frequency of typical downhole acoustic noise, which is typically in the range of 0 to 2 kHz. At 8 kHz, a signal can be transmitted acoustically through the drill string a distance of approximately 50 to 200 feet. This range corresponds to the distance from the drill bit to a receiver located just above the mud motor.

According to a preferred embodiment, the modulation time is preferably at least 12 msec. and is more preferably 20 to 100 msec. The preferred carrier pulse has a duration of approximately 10 to 300 cycles, after which time the pulse is terminated and the received signal consists of residual acoustical noise. It has been found that the ringdown period may be as long as several hundred cycles.

Since the subject invention is intended to operate with acoustic properties ranging over several orders of magnitude, which could occur in a single well, it is clearly advantageous and possibly necessary to provide for operation over a wide range of frequencies. The system is also preferably self-adaptive in selecting the proper operating frequency from time to time as formation changes.

The acoustic sensor has been designed to minimize the current drain on the sensor battery pack 55. While the tool is being run to bottom, the acoustic sensor module is in a low power "sleep" mode. Every few minutes, an internal clock in the sensor microprocessor 250, turns on the processor 250 and its associated circuitry for a few seconds, long enough to detect a predetermined sounding signal from the control module. If no such signal is detected by the acoustic sensor circuitry, the microprocessor and associated circuitry go back into the "sleep" mode until the next power-up period.

When communication is desired by the control module, based upon some condition such as a predetermined downhole pressure, mud flow, rotation, etc., the command module will initiate periodic transmission of sounding signals to command response from the sensor module. In the preferred embodiment, these signals consist of transmitted pulses of a few seconds' duration, alternating with receiving intervals of a similar duration to listen for a response from the sensor module.

Each transmit/receive cycle of the control module occurs within the period of time that the acoustic sensor module is receiving, thus guaranteeing control transmission during sensor reception.

The near bit sub is programmed to contact the control sub at selected quiet times when flow and rotation are stopped. Such periods occur when pipe is added to the drill string, for example. A single cycle low frequency pulse (approximately one-tenth of the carrier frequency) is emitted from the control module at prescribed firing intervals. The near bit receiver processor uses Equation (1) with a reference cycle at the low frequency, $f_{Low}$. The sample interval is one-tenth of the low frequency period. The time that the detected signal first breaks a threshold is used to establish a processing time window to calculate a highly accurate estimate of the first arrival of the single cycle. This estimate is used to synchronize clocks and calculate carrier signal arrival times to determine speed of sound.

The processing first correlates data points in the time window with $\sin(2\pi f_{Low} t)$. The maximum correlation occurs a half period after the first arrival. Valleys for anticorrelation occur a half period before and after the peak. Noise prevents accurate measurement of these peak timings. To increase accuracy, the amplitudes of data between the valleys are processed with the arc-cosine to give angles progressing linearly from 0 at the first valley to $2\pi$ at the second valley. In each quarter period, the ratio of each data point to the corresponding peak or valley is used as the argument for the arc-cosine. Data points having the wrong polarity are rejected. Using linear regression of the arc-cosine values versus the time produces a straight line that intersects the time axis at the first arrival time. This synchronization of the downhole clocks is needed to establish the time windows for processing data for either telemetry or measuring formation properties. Otherwise, drift of the two clocks may require continuous processing. Clocks are sufficiently stable to maintain accurate sample rates and to select time windows during the time required to drill one length of pipe. The stability of firing time intervals also permits stacking of hundreds of waveforms for windows on successive firings. This stacking (averaging) reduces random noise from drilling.

By comparing the stacked, correlated data for two receivers, the carrier signals can be processed with the arc-cosine procedure used for the low frequency signals. A comparison of the arrival time difference between the two receivers gives the propagation time between the receivers and hence the speed of sound.

The sensor module, upon detecting a sounding signal, responds at the low frequency. The control module then emits a series of pulses at prescribed candidate carrier frequencies. The near bit sub determines which of these candidate carrier frequencies has the best signal-to-noise ratio, and responds by transmitting a signal to the control module at that frequency. This transmission continues for a duration of at least a full cycle of control module transmission, to guarantee that a signal is sent from the sensor module while the control module is listening. Once two-way communication is established, subsequent transmissions are completely controlled at the most advantageous frequencies. If communication is lost, or if conditions change downhole, both modules revert to a sounding mode.

The sensor module 125 preferably monitors all six thermistors in the drill bit and all sensors located in the sensor sub 200, and transmits readings respecting each sensor to the control module, which preferably relays some or all of these signals to the surface via the host module and mud pulser at a maximum rate of once every five minutes. If it becomes a requirement that data be taken at a significantly higher rate than can be transmitted by mud pulse, data may be stored in memory downhole, or the data may be sorted downhole and/or transmitted to the surface at a rate commensurate with the mud pulse capabilities, or the capabilities of whatever relay telemetry system is used. If sensors are turned on and off (for conservation of batteries), and if a "turn-on" transient settling period is required, sufficient time is provided such that there is no significant biasing of the sample averages due to these transients.

I. Other Applications

The advantages provided by the present invention include the ability to transmit information from the near-bit sub to the uphole side of the mud motor. For example, information relating to bed boundaries, both ahead of bit and surrounding the borehole, can now be obtained from a near-bit sub and transmitted uphole, thereby greatly reducing the lag time in information and steering. High frequency, collimated beams can be sent at angles into the formation. Bed boundaries are located using these signals with a pitch-catch transducer configuration. For bed boundaries to the side of the bit and substantially parallel to its axis, near-bit transducers are preferably set to resonate at approximately 60 kHz. With a frequency of about 50 kHz or more, the wavelength is short enough to allow transducer sizes having radiation patterns collimated in the azimuth direction.

If pulse echo transducers having frequencies in the range of 200 kHz to 600 kHz are installed, the system can inspect the quality of cement behind casing as the bottom hole assembly is tripped in and out of the well. By using Equation 1 with several B reference frequencies, the pulse-echo signal will be correlated with several narrow band frequencies within the pass band of the transducer. Echoes remaining trapped in the borehole fluid will have the spectral response of the transducer, whereas echoes passing though casing will have the narrow band characteristics of the casing wall thickness mode. Equation 2 can be used to select the contribution in each time window from signals behind casing. Because a ratio method is used, most of the effects of downhole conditions on transducer response are canceled. This procedure, therefore, avoids the calibration difficulties encountered with conventional pulse echo casing inspection.

Similarly, because the fluid signal travels much more slowly than any signal transmitted through the drill string, the delayed return of a compressional wave can be used to get information about the formation ahead of bit. Copending application Ser. No. 08/544,723, filed Oct. 18, 1995, and titled "Acoustic Logging While Drilling Tool To Determine Bed Boundaries" provides a more detailed description of a technique for gathering data regarding bed boundaries and is incorporated by reference as if fully set forth herein.

Information about the formation boundaries ahead of the bit will have reduced interference from tool modes traveling through the Bottom Hole Assembly. Specifically, the mud motor effectively attenuates or erases the signal that would otherwise be transmitted through the drill string. Thus, the formation compressional wave that continues beyond the bit and reflects off of any boundary that is within its range can be distinguished from tool mode noise. These reflected waves return to the same receivers, arriving first at the receiver nearest the bit. This received signal can be correlated with the original signal that arrived first at the receiver farthest from the bit. By distinguishing between upward and downward arrivals and correlating the waveforms of the original and reflected waves, enhanced signal detection capability is obtained.

Information about the formation speed of sound can be obtained from the arrival times of the original signal at the first and second receivers and from knowing the distance between the receivers. Using equations (2) and (3), the frequency dependence of the speed of sound can be determined. This dispersion of the speed of sound relates to formation properties such as porosity and permeability.

Information about the formation acoustic attenuation can be obtained by comparing the signal strengths at the two receivers. The signal decay between the two receivers gives the attenuation per unit distance of propagation. Using Equations (2) and (3) to determine the attenuation as a function of frequency gives information about the physical conditions causing attenuation. Speed of sound dispersion is one cause of formation acoustic attenuation. For example, scattering from fractures and porosity give different frequency dependencies for formation acoustic attenuation.

While a preferred embodiment of the invention has been disclosed, various modifications can be made to the preferred embodiment without departing from the principles of the present invention.

We claim:

1. An acoustic data transmission system for transmitting measured operating, environmental and directional parameters in a well from a first point on a drill string to a second point on the drill string, a portion of the drill string between the first and second points including acoustic noise generated by the drilling process, said system comprising:

a first acoustic apparatus for transmitting and receiving an acoustic signal along a path through the drill string; and a second acoustic apparatus for transmitting and receiving an acoustic signal along a path through mud in the well annulus.

2. The system according to claim 1 wherein said first acoustic apparatus includes a first transmitter and a first receiver axially spaced from said transmitter, said first transmitter and first receiver being acoustically isolated from the drilling mud.

3. The system according to claim 2 wherein said first acoustic apparatus transmits and receives shear waves.

4. The system a ccording to claim 3 wherein said first transmitter and receiver each comprise a ring of transducers in a plane perpendicular to the axis of the drill string.

5. The system according to claim 4 wherein said transducer rings are divided into arcuate portions and said portions of said transmitter ring are alternately fired so as to transmit a shear wave through the drill string.

6. The system according to claim 5 wherein said first acoustic apparatus further comprises an additional transmitting transducer ring and an additional receiving transducer ring, said additional rings being adapted to apply to the drill string a shear wave having a different azimuthal orientation from that applied by said first transmitter and receiver.

7. The system according to claim 2 wherein said first acoustic apparatus uses two or more distinct frequencies to transmit binary information.

8. The system according to claim 1 wherein said second apparatus includes a second transmitter and a second receiver axially spaced from said transmitter, said second transmitter and second receiver being acoustically isolated from the drill string.

9. The system according to claim 8 wherein said second receiver comprises an axially extending array of receiving devices.

10. The system according to claim 9 wherein each of said receiving devices is mounted on the drill string in a signal damping housing.

11. The system according to claim 8 wherein said second acoustic apparatus transmits and receives compression waves.

12. The system according to claim 11 wherein said second acoustic apparatus uses two or more distinct frequencies to transmit binary information.

13. The system according to claim 1, further including a third acoustic apparatus for transmitting and receiving an acoustic signal along a path through the formation.

14. The system according to claim 13 wherein said third acoustic apparatus comprises a third transmitter and a third receiver, said third transmitter and said third receiver being acoustically isolated from said drill string.

15. A method for transmitting signals in a well that contains a drill string, comprising the steps of:

(a) providing separate acoustic means for transmitting separate acoustic signals through the drill string and the mud in the annulus;

(b) providing separate acoustic means for receiving said separate acoustic signals transmitted through the drill string and the mud in the annulus;

(c) transmitting said separate acoustic signals through the drill string and the mud in the annulus;

(d) receiving said separate acoustic signals from the drill string and the mud in the annulus;

(e) correlating said separately received signals according to the times required for each signal to complete its transmission path; and (f) interpreting said correlated signals.

16. The method according to claim 15 wherein said transmitting step comprises transmitting a pulse at a first frequency to indicate a digital "1" and transmitting a pulse at a second frequency to indicate a digital "0".

17. The method according to claim 16 further including the steps of determining a ringdown time for the drill string and surroundings and modulating said frequencies on an interval greater than said ringdown time.

18. The method according to claim 17 wherein said interpreting step comprises filtering said correlated signal to identify signals at said first and second frequencies.

19. The method according to claim 18 further including the step of querying the transmitting device when no recognizable signal is received.

20. The method according to claim 15 wherein the drill string includes a mud motor and the signals are transmitted across the motor.

21. A method for transmitting acoustic data signals a short distance in a well containing an acoustic noise generator, said method comprising the steps of:

(a) transmitting frequency shift keyed shear waves through said acoustic noise generator;

(b) transmitting frequency shift keyed compression waves through mud in the well annulus;

(c) receiving and processing said shear waves to generate a first received signal;

(d) receiving and processing compression waves to generate a second received signal; and (e) correlating said first and second received signals and generating a received data stream.

22. The method according to claim 21 wherein at least one of the shear waves and compression waves is transmitted across the acoustic noise generator.

23. A method for collecting information relating to a formation from a device housed in a bottomhole assembly, comprising the steps of:

(a) transmitting acoustic signals into the formation;

(b) receiving reflected and refracted acoustic signals;

(c) generating an electrical signal representative of the received signals;

(d) correlating the received reflected and refracted acoustic signals with a reference signal;

(e) determining the time lag for the received acoustic signals;

(f) identifying formation anomalies based upon the time lag determination.

24. A method as in claim 23, wherein the acoustic signals are transmitted in front of the bottomhole assembly.

25. A method as in claim 23 wherein the correlating step (d) includes reducing noise from the received signals by carrying out the following steps:

(d1) sampling the received signal at a given sampling rate so as to give a plurality of sample points, the received signal having a carrier frequency such that a first number of sample points corresponds to one carrier cycle;

(d2) generating a reference signal having at least as many reference points as the number of points per carrier cycle; and (d3) for each set of successive points in the received signal equaling the number of reference signal points, (d3i) multiplying each sample point by a corresponding reference point and summing the products so generated;

(d3ii) assigning the sum of the products an associated time value equal to the time of the midpoint of the set of successive points;

(d3iii) advancing the values of the received signal points by one time increment; and (d3iv) repeating steps (d3i) through (d3iii) until each sample point has produced a sum of products and an associated time; and (d4) processing the set of product sums and associated times to create an envelope of the carrier amplitude for the components correlated with the reference signal.

26. A method as in claim 25, further including the step of correlating the values of the carrier envelope in a time window to a second reference signal associated with the modulation frequency of the carrier envelope to give a distinct bit of information.

27. A method for collecting information relating to a formation from a device housed in a bottomhole assembly, comprising the steps of:

(a) transmitting acoustic signals into the formation;

(b) receiving reflected and refracted acoustic signals;

(c) generating an electrical signal representative of the received signals;

(d) correlating the received acoustic signals with a reference signal;

(e) determining the time lag for the received acoustic signals;

(f) identifying calculating a formation speed of sound based upon the time lag determination.

28. A method as in claim 27 wherein the correlating step (d) includes reducing noise from the received signals by carrying out the following steps:

(d1) synchronizing the clocks in two subs using a frequency lower than the carrier frequency to establish time windows for collecting stacked digitized waveforms;

(d2) sampling the received signal in time windows at a given sampling rate so as to give a plurality of sample points, the received signal having a carrier frequency such that a first number of sample points corresponds to one carrier cycle;

(d3) generating a reference signal having at least as many reference points as the number of points per carrier cycle; and (d4) for each set of successive points in the received signal equaling the number of reference signal points, (d4i) multiplying each sample point by a corresponding reference point and summing the products so generated;

(d4ii) assigning the sum of the products an associated time value equal to the time of the midpoint of the set of successive points;

(d4iii) advancing the values of the received signal points by one time increment; and (d4iv) repeating steps (d4i) and (d4iii) until each sample point has produced a sum of products and an associated time;

(d5) processing the sums to find a threshold at which an envelope point exceeds the running average of a window of previous envelope points by a prescribed amount and using the timing of this point to select a timing window for accurately measuring acoustic arrival time; and (d6) accurately measuring arrival time by performing a least squares fit of the angles obtained by transforming trigonometrically from data point amplitudes to increasing phase angle and selecting the intercept with the time axis as arrival time.

29. A method as in claim 28, further including the steps of correlating the values of two receivers spaced a known distance apart to determine the travel time and hence the speed of sound of the correlated acoustic wave propagation modes.

30. A method for transmitting data around a downhole assembly, comprising the steps of:

(a) transmitting data having a carrier frequency and a modulation frequency from a point on a first end of the downhole assembly;

(b) receiving said data at a point on an opposite end of the downhole assembly;

(c) correlating said received data with first and second reference signals having different frequencies to generate a modulated received signal, one of said reference signals having a frequency corresponding to said carrier frequency;

(d) correlating the modulated received signal with a third reference signal to generate a plurality of bits of information.

31. A method for determining formation acoustic attenuation, comprising the steps of:

(a) transmitting a signal A1 having a first carrier frequency $f_1$;

(b) transmitting a signal A2 having a second carrier frequency $f_2$ said second carrier frequency being different from said first carrier frequency;

(c) receiving said signals A1 and A2 at first and second spaced-apart receivers;

(d) calculating the formation attenuation from the signal decay per unit distance of propagation between the receivers;

(e) correlating said received signals A1 and A2 with first and second reference signals B1 and B2 having frequencies corresponding to said first and second frequencies respectively $f_1$ and $f_2$, so as to generate first and second sets of correlated data $D_1$ and $D_2$;

(f) taking the ratio R1 of $D_1$ and $D_2$;

(g) comparing R1 with threshold levels to determine which frequency is being received or whether noise prevented frequency detection; and (h) using the information from steps (d) and (g) to determine the frequency dependence of the formation attenuation if a frequency is received or querying the transmitter to repeat transmissions if only noise is detected.

32. A method for obtaining information about a formation, comprising the steps of:

(a) transmitting a signal A1 having a first carrier frequency $f_1$;

(b) transmitting a signal A2 having a second carrier frequency $f_2$ said second carrier frequency being different from said first carrier frequency;

(c) receiving said signals A1 and A2 at first and second spaced-apart receivers;

(d) calculating the formation speed of sound from the arrival times of the signal at the first and second receivers;

(e) correlating said received signals A1 and A2 with first and second reference signals B1 and B2 having frequencies corresponding to said first and second frequencies respectively $f_1$ and $f_2$, so as to generate first and second sets of correlated data $D_1$ and $D_2$;

(f) taking the ratio R1 of $D_1$ and $D_2$;

(g) comparing R1 with threshold levels to determine which frequency is being received or whether noise prevented frequency detection; and (h) using the information from steps (d) and (g) to determine the frequency dependence of the formation speed of sound if a frequency is received or querying the transmitter to repeat transmissions if only noise is detected.

33. A method for obtaining information from time windowed data, comprising the steps of:

(a) transmitting a signal A1 having a first carrier frequency $f_1$;

(b) transmitting a signal A2 having a second carrier frequency $f_2$ said second carrier frequency being different from said first carrier frequency;

(c) receiving said signals A1 and A2;

(d) correlating said received signals A1 and A2 with first and second reference signals B1 and B2 having frequencies corresponding to said first and second frequencies respectively $f_1$ and $f_2$, so as to generate first and second sets of correlated data $D_1$ and $D_2$;

(f) taking the ratio R1 of $D_1$ and $D_2$;

(g) comparing R1 with threshold levels to determine which frequency is being received or whether noise prevented frequency detection; and (h) using the information from steps (d) and (g) to determine the frequency dependence of a measured property if a frequency is received or querying the transmitter to repeat transmissions if only noise is detected.

34. A method for obtaining information about cement behind casing, comprising the steps of:

(a) transmitting from a transducer an acoustic pulse of sufficient bandwidth to include the thickness resonance frequencies of all applicable casing wall thicknesses;

(b) receiving echoes from the casing with a receiving transducer;

(c) processing the received signals by correlating with selected narrow band reference frequencies to determine casing wall thickness in the time window immediately after the first reflection from the inner casing wall; and (e) processing later time windows at the wall thickness resonance frequency to detect signals from reflective boundaries behind casing.

35. The method according to claim 34 wherein said transmitting transducer is also said receiving transmitter.

* * * * *